US006860327B2

(12) United States Patent
George

(10) Patent No.: US 6,860,327 B2
(45) Date of Patent: Mar. 1, 2005

(54) PRESSURE CONTAINING ASSEMBLY USED TO DETECT THE LOCATION OF ANOMALIES WITHIN A BLOWOUT PREVENTER (BOP) STACK

(75) Inventor: Ashley George, Houston, TX (US)

(73) Assignee: Woodco USA, Houston, TX (US)

( * ) Notice: Subject to any disclaimer, the term of this patent is extended or adjusted under 35 U.S.C. 154(b) by 88 days.

(21) Appl. No.: 10/304,447

(22) Filed: Nov. 26, 2002

(65) Prior Publication Data

US 2004/0099415 A1 May 27, 2004

(51) Int. Cl.[7] ..... E21B 47/01
(52) U.S. Cl. ..... 166/250.01; 166/66
(58) Field of Search ..... 166/250.01, 255.1, 166/250.11, 66, 243

(56) References Cited

U.S. PATENT DOCUMENTS 3,114,876 A * 12/1963 Schuster ..... 324/242
4,852,648 A * 8/1989 Akkerman et al. ..... 166/66.4
4,922,423 A * 5/1990 Koomey et al. ..... 702/39
5,014,781 A 5/1991 Smith ..... 166/66.5
2003/0010495 A1 * 1/2003 Mendez et al. ..... 166/255.1

* cited by examiner

*Primary Examiner*—Zakiya Walker
(74) *Attorney, Agent, or Firm*—Osha & May L.L.P.

(57) ABSTRACT

An anomaly detector, used to sense the presence of tool collars, tool joints and other structures within a longitudinal space, that includes a protective housing. Sensory components are disposed within the protective housing and a port is provided for communication between internal and external components of the sensory system. A pressure containing region within the housing prevents the loss of pressure from within the detector, and protects the various components of the system from fluids and other materials constrained within the longitudinal space.

20 Claims, 7 Drawing Sheets

("Prior Art")

PRESSURE CONTAINING ASSEMBLY USED TO DETECT THE LOCATION OF ANOMALIES WITHIN A BLOWOUT PREVENTER (BOP) STACK

BACKGROUND OF INVENTION

The present invention relates generally to (but is not limited to) snubbing units that are used to vertically move a tubing string, formed from a series of tubing joints serially interconnected by larger diameter threaded tubing collars, or threaded upset ends, into and out of a pressurized well bore.

The typical snubbing unit used to vertically move a jointed tubing string into and out of a pressurized well bore moves the tubing string through a stationary riser spool on which vertically spaced upper and lower blowout preventers (BOPs) are operatively mounted. As is well known in this art, the BOPs are used to isolate the interior of the riser spool portion above them (normally at ambient pressure) from the much higher well pressure in the riser spool portion below them, while at the same time being openable and closable in "air lock" fashion to permit sequential passage therethrough of a series of tubing joint collars. Each BOP is sized so that in its closed position it forms a sliding pressure seal around the tubing joint being moved therethrough, and in its open position permits passage therethrough of the larger diameter tubing collar.

During lowering of a particular tubing collar toward the upper BOP, the upper BOP is open, and the lower BOP is closed. When the collar enters the intermediate riser spool portion between the upper and lower BOP's, downward tubing string travel is halted and the upper BOP is closed. The interior of the intermediate riser spool portion is then brought to well pressure by opening an equalizing valve to communicate the intermediate riser spool portion with such well pressure. After this pressure equalization is achieved, the lower BOP is opened, and the tubing string is further lowered to move the collar downwardly past the open lower BOP.

The lower BOP is then closed, and the interior of the intermediate riser spool portion is vented to the atmosphere by opening a bleed-off valve operatively connected to the intermediate riser spool portion. The upper BOP is then opened to ready the intermediate riser spool portion for downward receipt of the next tubing collar. A reverse sequence of BOP opening and closing, and pressurization and depressurization of the intermediate riser spool portion interior is, of course, used as the tubing string is being moved upwardly through the riser spool by the snubbing unit.

In the snubbing operation described above, it is important to temporarily terminate vertical tubing string movement after each tubing collar has entered the intermediate riser spool section through the open BOP, and before the collar strikes the closed BOP, to permit the necessary condition reversal of the BOPs and the pressurization or depressurization of the intermediate riser spool portion interior. Failure to temporarily stop each tubing collar at this position, as is well known, can cause severe disruptions of and lengthy delays in the snubbing operation.

For example, during forcible lifting of the tubing string through the riser spool, if a tubing collar is not stopped upon its upward entry into the intermediate riser spool portion it will forcibly strike the underside of the closed upper BOP. The continuing lifting force on the tubing string above the closed upper BOP can easily tear the tubing string apart at the jammed collar, thereby permitting the entire lower portion of the string to fall to the bottom of the well bore and causing a well blowout through the upper BOP. Also, if the tubing is being forcibly lowered through the riser spool, and a tubing collar strikes the closed lower BOP, the portion of the tubing string above the jammed collar can be easily crumpled and wedged within the riser spool.

The requisite precise positioning, and temporary stoppage, of each vertically successive tubing collar within the intermediate riser spool portion has been somewhat difficult to determine for two primary reasons. First, after each tubing collar enters the BOP assembly, it can no longer be seen by the snubbing unit operator. Second, there is often at least a slight variation in the collar-to-collar lengths in the tubing string. This arises from tubing joint length variances. Accordingly, it has been previously necessary for the snubbing unit operator to laboriously keep track of each successive collar-to-collar length in the tubing string to facilitate the essentially "blind" placement and stoppage of each collar within the intermediate riser spool portion. A slight calculation error, or an attention lapse by the snubbing unit operator, can thus easily cause breakage or crumpling of the tubing string One method of determining the position of a tubing collar or joint within a BOP stack is demonstrated in U.S. Pat. No. 5,014,781 issued to Smith. Referring now to FIG. 1, a device according to Smith detects the approximate position of a collar 124 within a BOP stack 110 through the use of an upper 152 and a lower 154 electromagnetic coil affixed to the exterior of an intermediate riser spool section 114.

SUMMARY OF INVENTION

In accordance with an embodiment of the invention, an apparatus is provided in which the presence of an anomaly of a longitudinal tube can be sensed through the use of one or more sensory components. The apparatus includes an external housing, for protection of the sensory components from external conditions. The external housing of this embodiment may also play a role in supporting an internal pressure-containing region.

In accordance with an embodiment of the invention, a method is provided for determining the presence of an anomaly of a longitudinal tube within a longitudinal hollow. Detection of direction of motion may also be determined through the use of directional sensory components or through the use of a plurality of sensory components, mounted within a protective housing.

Other aspects and advantages of the invention will be apparent from the following description and the appended claims.

DETAILED DESCRIPTION

Figure 1:
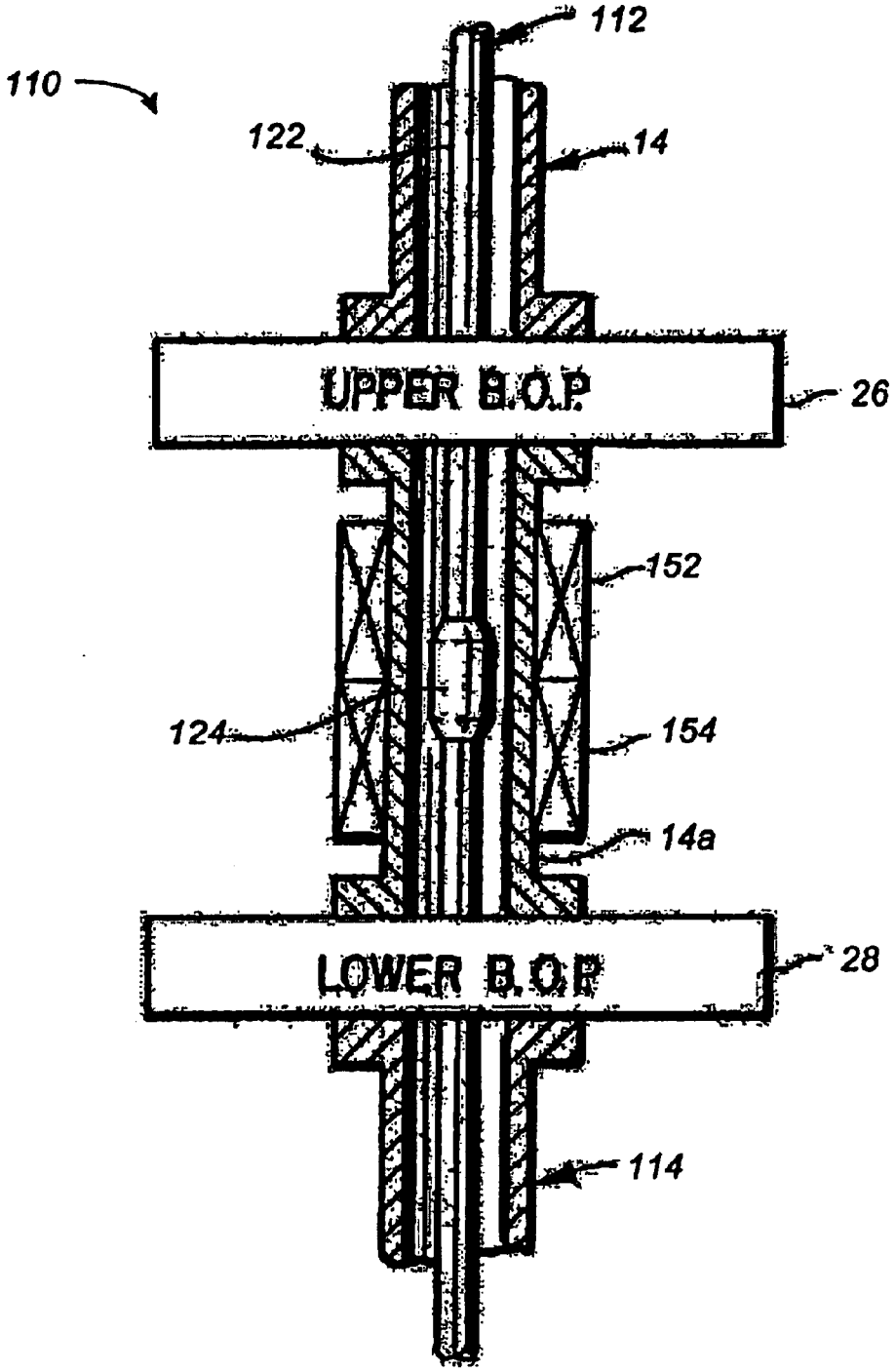
FIG. 1 is a prior art sensor device.
Figure 2:
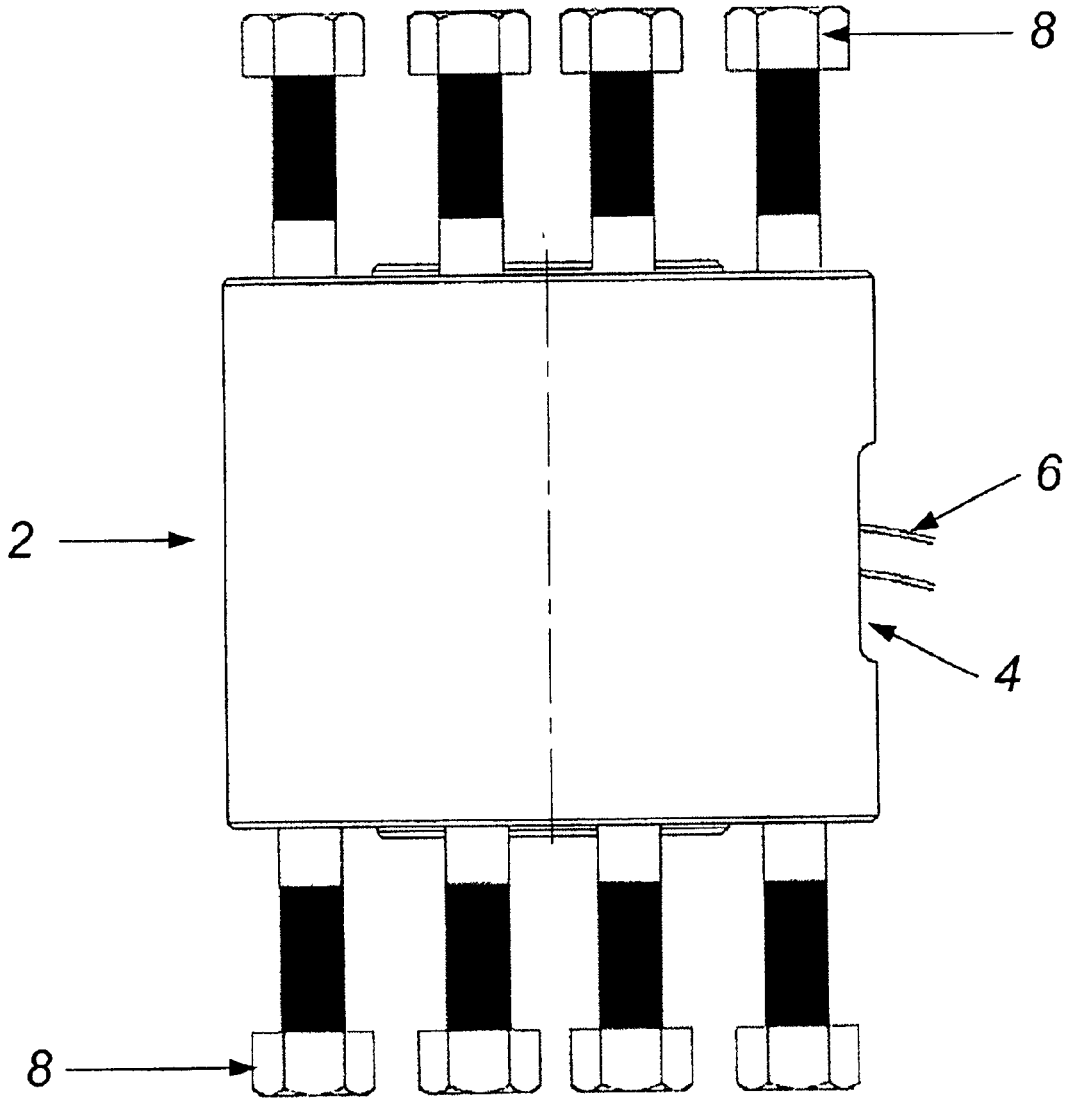
FIG. 2 is a side view of an embodiment of the invention.

Referring to the drawings wherein like reference characters are used for like parts throughout the several views, FIG. 2 shows, in accordance with an embodiment of the present invention, a housing 2 of a pressure containing anomaly detector ("PCAD"). In this embodiment, the housing 2 include a port 4 for communication with sensors or other components (not shown) located within the housing 2. The housing 2 has one or more fasteners 8 disposed along the top and bottom for attaching the PCAD to adjacent components (not shown), including those commonly used in a BOP stack. These fasteners 8 may be of any form commonly used in the industry, including, but not to, tap end studs, and the housing 2 may be adapted to use various fasteners 8. Such adaptation may include threaded holes, lips, indentations, threads and any other adaptations necessary to interact with a desired type of fastener 8. Adjacent components may include, but are not limited to, tubes, pipes and spacers, such as may be used in oilfield applications. Furthermore, in another embodiment, the housing 2 of the PCAD may be integrated into such components so as to form a single unit.

Figure 3B:
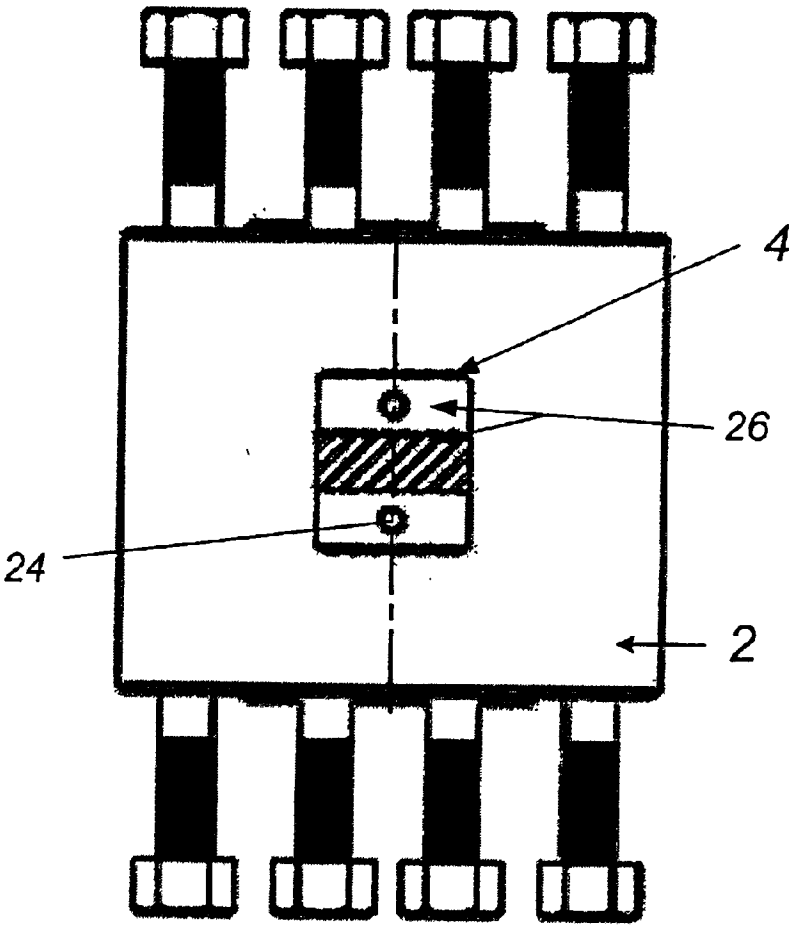
FIG. 3*b* is a frontal view of an embodiment of the invention, with interface removed and internal members visible.
Figure 3A:
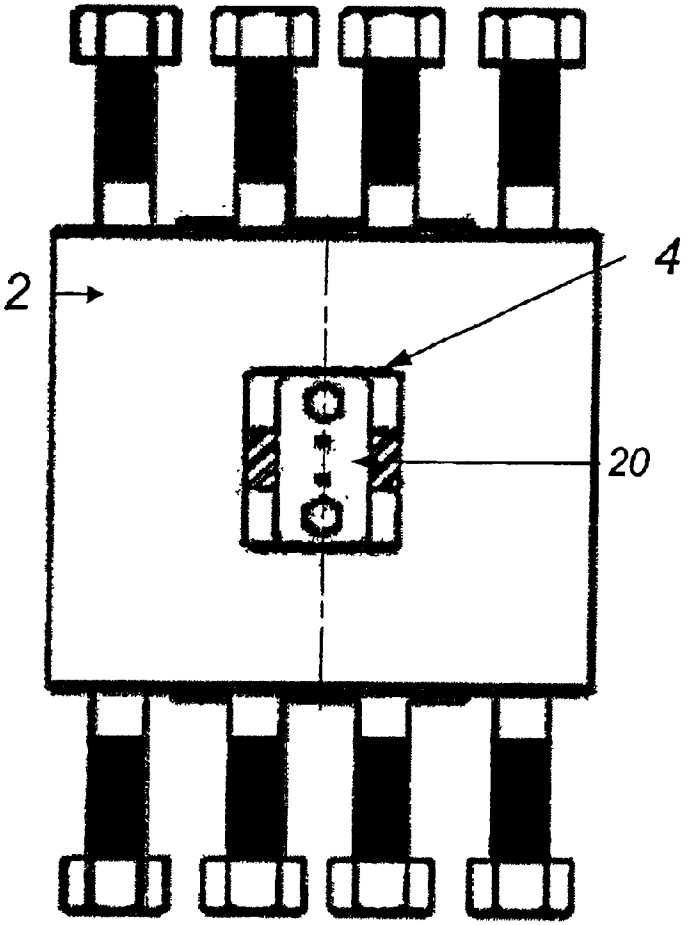
FIG. 3*a* is a frontal view of an embodiment of the invention, showing position of interface.

The port 4 of an embodiment of the PCAD housing 2 is visible in FIG. 3*a*. One or more sensors or other components (not shown) may be disposed within the port 4. Placement of components within the port 4 allows easy access for maintenance, upgrades, removal or installation of components. In keeping with such uses, the port 4 may vary in size, shape and structure based on the types of components used, the level of accessibility desired, the need to maintain the integrity of the housing 2 under various internal pressures, and other considerations.

Within the port 4, may be mounted an interface 20. This interface 20 permits communication between external components (not shown) of the sensing system, and internal components, such as coils and internal sensors (not shown), as will be discussed in detail. Furthermore, the interface 20 itself may include one or more sensory components. This interface 20 may be inset, so that it does not protrude beyond the housing 2. Mounting of the interface 20 in such an inset fashion protects it from damage and external elements. Furthermore, if a larger interface 20 is needed, it may protrude beyond the external housing. One or more wires (shown at 6 in FIG. 2) may connect to or through the interface 20.

FIG. 3*b* shows a PCAD with the interface 20 removed. One or more seals 26, if present, are visible through the unobstructed port 4. One or more holes 24 may be disposed in the one or more seals 26, for connection of the interface 20. The seals 26 may comprise magnetic or non-magnetic materials, and may be stacked, as will be described in detail with regard to FIG. 5.

Figure 4:
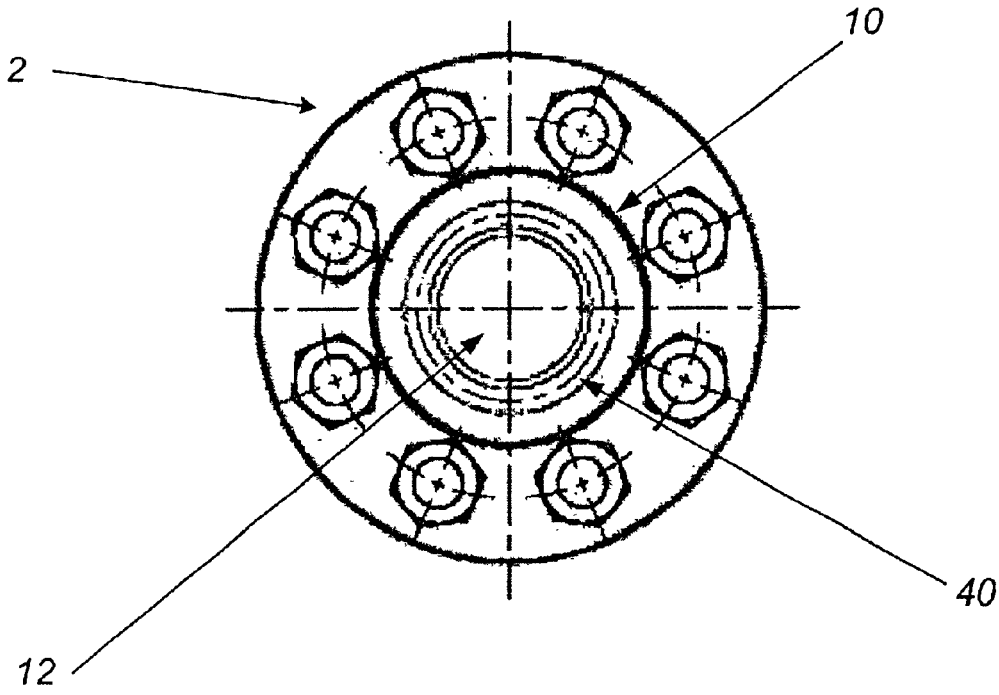
FIG. 4 is a top down view of an embodiment of the invention.

FIG. 4 is a top-down perspective of an embodiment of a PCAD. In the embodiment of FIG. 4, the housing 2 is circular in shape; however, other shapes may also be desired and implemented in various embodiments of the invention. An inner passage 12 is located within the housing 2. Anomalies of a tube (not shown) or other structures passing through this inner passage 12 may be detected by one or more sensory components (not shown) disposed within the PCAD. An isolation sleeve 10 may be disposed between the housing 2 and inner passage 12. The isolation sleeve 10 shown has a circular cross-section, however, the shape of the sleeve may vary depending on various considerations, such as the shape of the housing 2. The isolation sleeve 10 may be plastic, or any other suitable material. It may be desirable that the material of the isolation sleeve 10 be non-conductive in order to minimize interference with the detection ability of the PCAD.

Also, disposed between the housing 2 and inner passage 12 and within the inner sleeve 12 if present, will be a pressure containing region ("PCR") 40. This PCR 40 may include one or more seals, a longitudinal sleeve, or other elements used in the art for containment of pressure within a defined space. In one or more embodiments, an isolation sleeve 10 is disposed between the PCR 40 and housing 2. If the PCR 40 comprises a plurality of seals, these seals may be stacked within the housing as demonstrated in FIG. 5.

Figure 5:
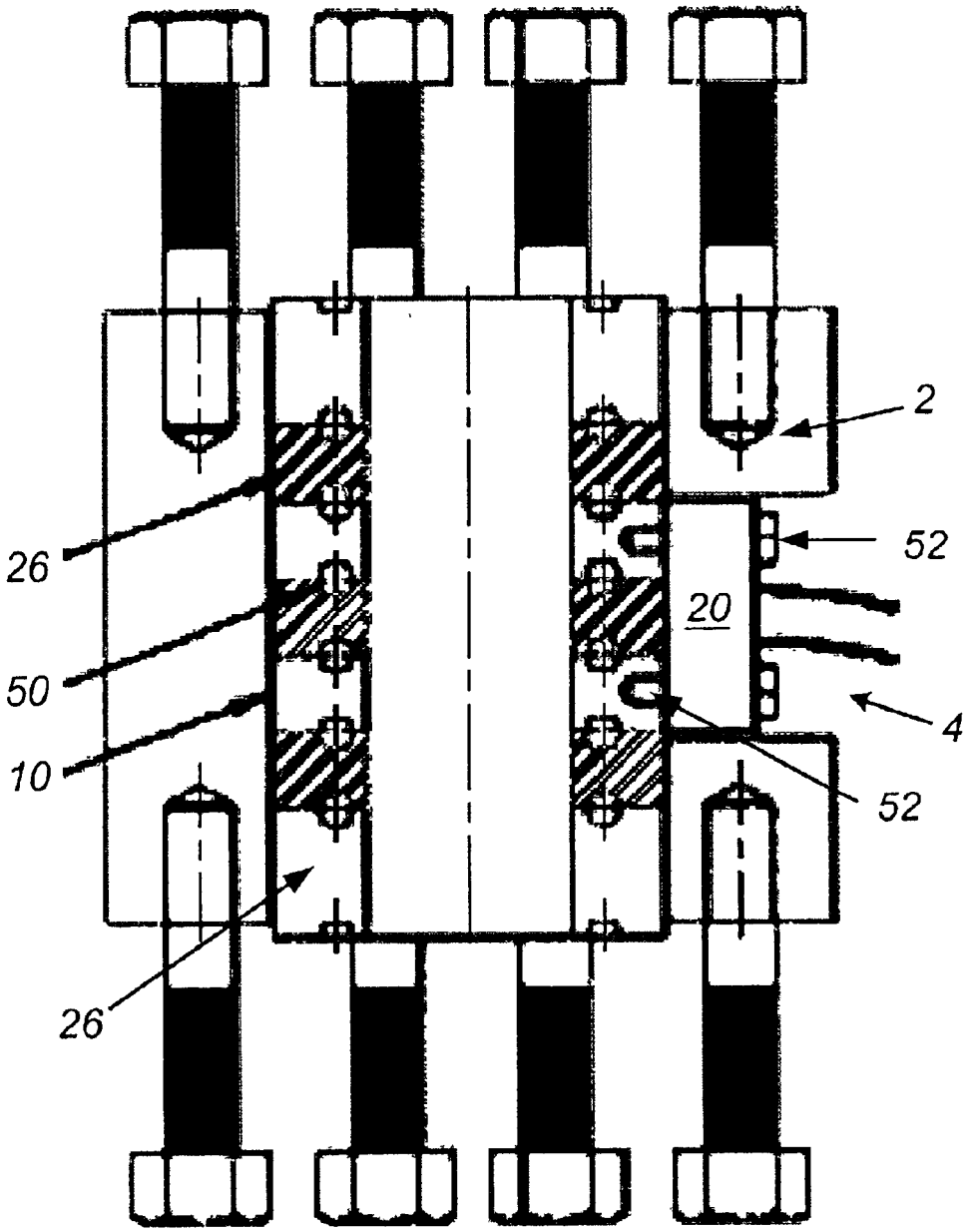
FIG. 5 is a cutaway side view, showing internal members.

In the embodiment of FIG. 5, a series of stacked seals 26 disposed within the PCR 40, form a barrier surrounding the inner passage 12. The interior surface of the seals 26 forms the inner passage 12, while the exterior surface of the seals 26 may be surrounded by an isolation sleeve 10. Between each seal 26 and the next, a gasket 50 is disposed to contain the pressure within the inner passage. Gaskets 50 may comprise any material commonly used in the art. In one or more embodiments, the gaskets 50 comprise a metal. The stack of seals 26 may extend beyond the upper and lower ends of the housing 2. Such a configuration allows the stack to be compressed when the housing 2 is fastened between various other components including BOPs, spools, adapters, tubes, pipes and spacers, such as may be used in oilfield applications.

The seals 26 may be of any magnetic or non-magnetic substance known in the art. In one embodiment, adjacent seals 26 within the stack will alternate between magnetic and non-magnetic composition. Certain of the seals 26 may be adapted to connect to the interface 20, by means of connecting members 52. Such adaptation may include holes for attachment by means of bolts, or similar connectors. However, the connecting members 52 may be of any type commonly used in the art. Connecting members 52 may also play a secondary role, such as the conduction of current to and from seals 26 and/or sensors.

Each seal 26 in a stack may be formed of discreet subparts, for instance an inner ring (not shown) proximal the inner passage 12 and an outer ring (not shown). Furthermore, seals 26 or the rings forming the seals 26 may comprise or contain coils or other components of a detection system. For instance, if induction balance technology is used in the sensor system, the outer ring of a seal 26 may comprise a transmitter coil while the inner ring comprises a receiver coil. However, the seals 26 and other components of the PCAD may be adapted for any type of sensor technology known in the art, including, but not limited to, pulse induction and beat-frequency oscillation technologies, as well as non-electrical or non-magnetic systems.

In one embodiment of a PCAD, entry of a tool collar, or other anomaly into the inner passage of the device will be detected by a sensory component nearest the anomaly and a signal will be transmitted to an indicator. As the anomaly nears the sensor, a stronger signal will be transmitted to the indicator. The use of various sensory components and configurations will allow for increased accuracy and directional detection. Such components may be of any type known in the art. Because a PCAD creates a protected environment for the disposition of sensory components, more sensitive components may be used.

Figure 6:
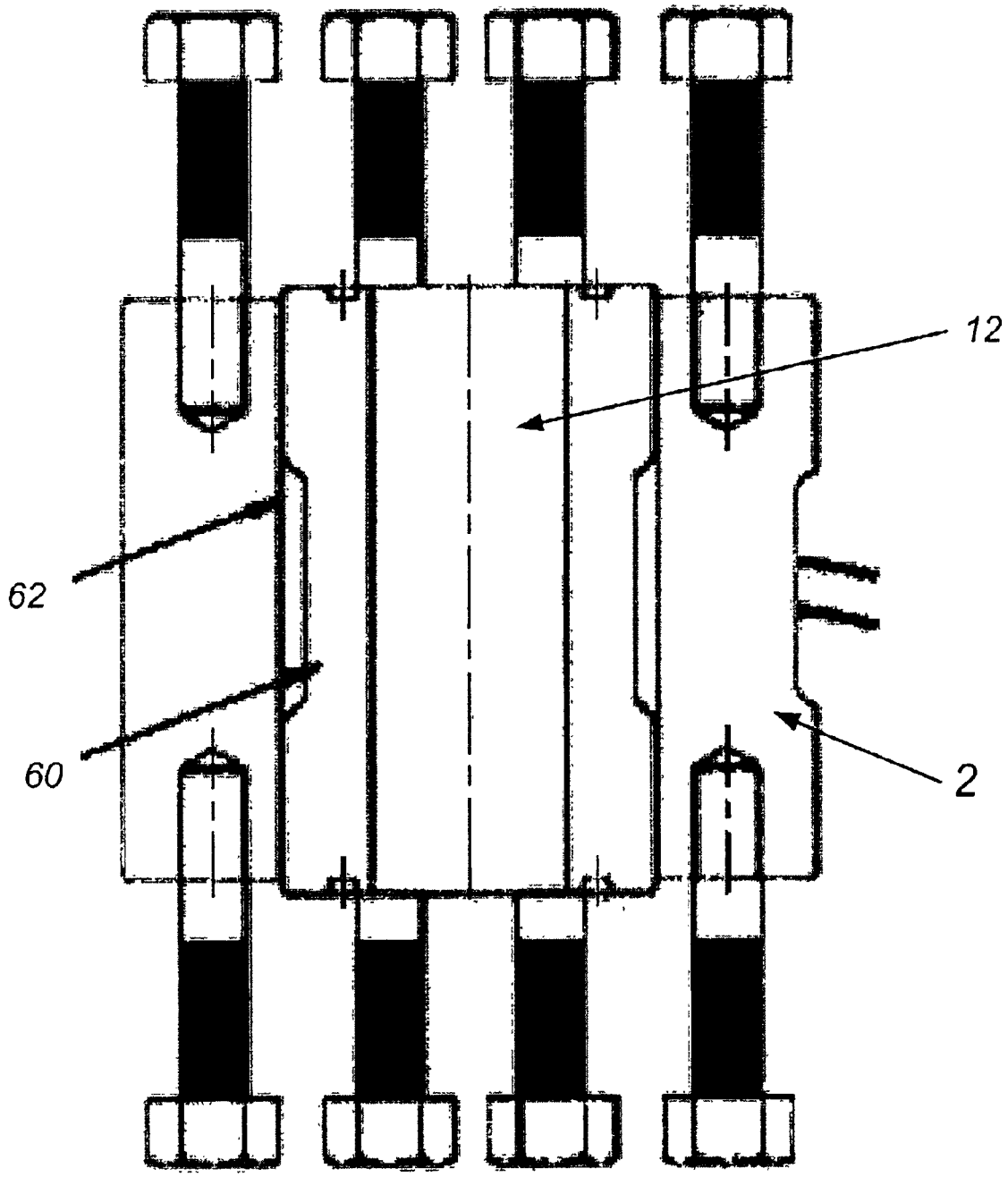
FIG. 6 is an embodiment of the invention, showing internal recess.

In one embodiment of the PCAD, shown in FIG. 6, a tubular member 60 may be disposed between the inner passage 12 and the housing 2. In one or more embodiments, the tubular member 60 is non-magnetic. A recess 62 may be formed in the tubular member 60. A coil (not shown) or other sensory component may be disposed at least partially within this recess 62. Alternatively, a coil (not shown) or other sensory component may be integrated into the tubular member 60 itself. Interior and exterior walls of the tubular member may be configured in any fashion based on the need to accommodate sensory components, and other considerations, including manufacturing costs. Furthermore, the tubular member 60 may contain spaces or hollows (not shown) in order to accommodate sensory components, or lower manufacturing costs. The tubular member 60 may extend beyond the top or bottom of the housing 2, in such fashion that it will be compressed by other components (not shown) attached to the housing 2.

Figure 7:
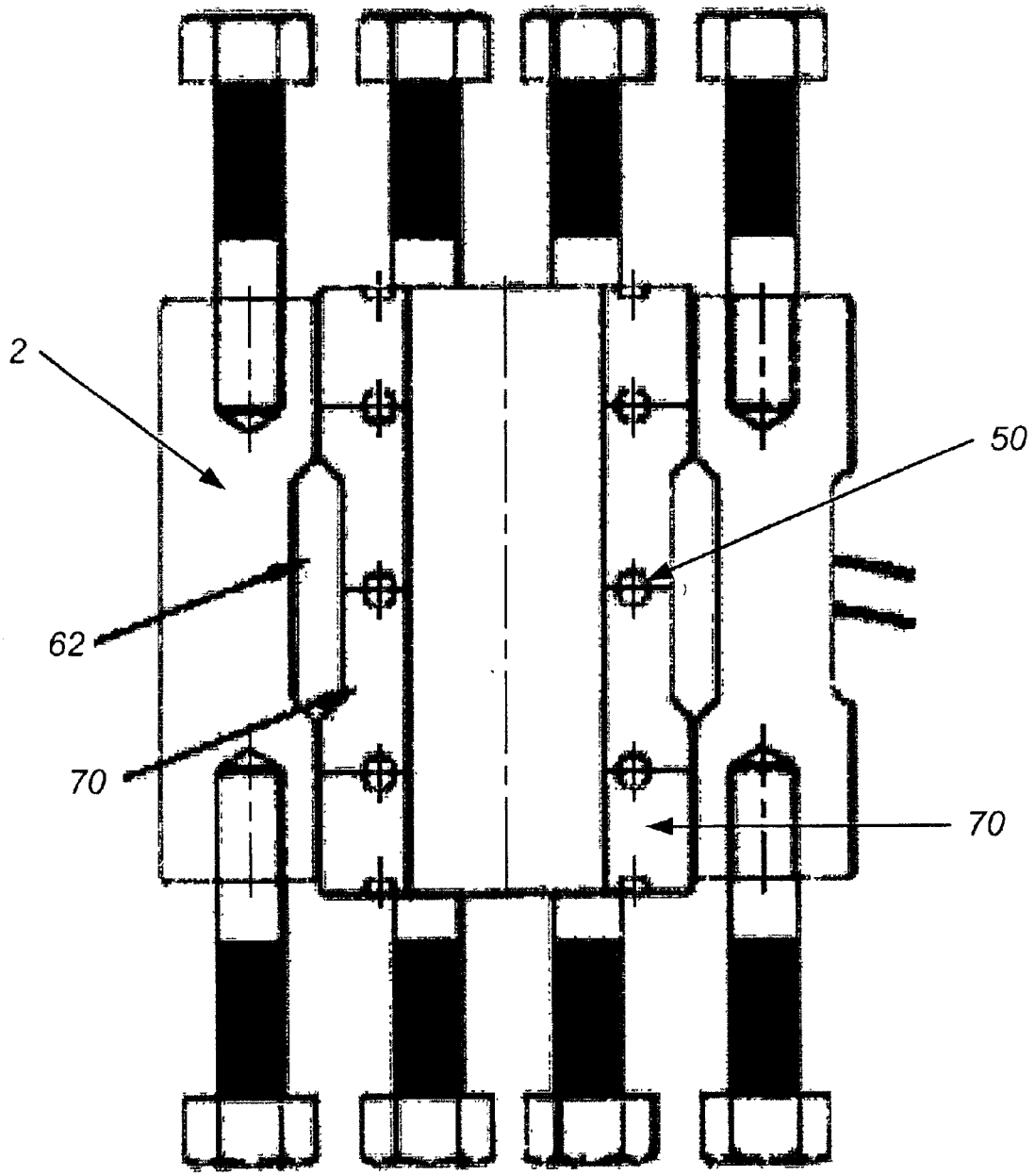
FIG. 7 is an embodiment of the invention, showing internal recess.

As shown in the embodiment of FIG. 7, the recess 62 may also be formed in the housing 2, either alone, or in combination with a recess 62 in the tubular insert (60 in FIG. 6) or a recess 62 formed in a series of stacked sections 70. Any number of sections 70 may be used to form the stack. Furthermore, metal gaskets 50 may be disposed between the stacked sections 70, ensuring the pressure containing integrity of the stack. In one or more embodiments, the sections 70 are non-magnetic, however, sections 70 may comprise any material known in the art. In an alternative embodiment, adjacent sections 70 may have differing compositions. Sections 70 may contain internal spaces or hollows (not shown) in order to lower manufacturing costs, or provide for the disposition of sensory or other components of the PCAD.

Although the invention has been described with reference to oilfield applications, such an apparatus may be used in any field where it is desirable to detect the presence, position, or movement of an anomaly within a longitudinal space. The protective advantages of the housing 2, and PCR 40, although useful in oilfield and similar applications where it is necessary to contain pressure within the housing 2, may be similarly useful in applications where it is necessary to prevent the entry of external materials into a controlled environment existing within the housing 2.

Advantages of embodiments of the present invention may include one or more of the following. Embodiments of the present invention provide the ability to use more sensitive detection components and protect them from damaging conditions. Embodiments of the present invention provide the ability to operate in a sub-sea or other harsh environments. The sensitivity of anomaly detection can be increased because sensory components may be mounted closer to the path of an anomaly. Ease of repair or replacement is increased for the few elements that are exposed to the environment (e.g., the wires or interface). Embodiments of the invention may also provide a more economical approach to anomaly detection because standard materials may be used in construction of the housing while the more expensive, non-conductive structural compositions can be limited to internal structures.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An apparatus for detecting the presence of an anomaly within a longitudinal hollow, comprising:

a housing having an inner passage passing therethrough;

a pressure-containing region disposed between the inner passage and the housing; and, a sensory component at least partially disposed between the inner passage and an outer periphery of the housing.

2. The apparatus of claim 1, wherein the anomaly comprises one selected from the group consisting of a collar, a joint and threaded upset ends of a tube disposed within the longitudinal hollow.

3. The apparatus of claim 1, wherein the pressure-containing region comprises a tubular member.

4. The apparatus of claim 3, wherein the tubular member is non-magnetic.

5. The apparatus of claim 3, wherein the tubular member includes a recess.

6. An apparatus for detecting the presence of an anomaly within a longitudinal hollow, comprising:

a housing having an inner passage passing therethrough;

a pressure-containing region disposed between the inner passage and the housing; and, a sensory component at least partially disposed between the inner passage and an outer periphery of the housing, wherein an isolation sleeve is disposed between the housing and the pressure-containing region disposed between the inner passage and housing.

7. An apparatus for detecting the presence of an anomaly within a longitudinal hollow, comprising:

a housing having an inner passage passing therethrough;

a pressure-containing region disposed between the inner passage and the housing; and, a sensory component at least partially disposed between the inner passage and an outer periphery of the housing, wherein the pressure-containing region comprises stacked seals.

8. The apparatus of claim 7, wherein the stacked seals include at least one gasket disposed between a first seal and a second seal.

9. The apparatus of claim 7, wherein at least one seal is non-magnetic.

10. An apparatus for detecting the presence of an anomaly within a longitudinal hollow, comprising:

a housing having an inner passage passing therethrough;

a pressure-containing region, comprising a tubular member, disposed between the inner passage and the housing, and, a sensory component at least partially disposed between the inner passage and an outer periphery of the housing, wherein the housing includes a recess.

11. An apparatus for detecting the presence of an anomaly within a longitudinal hollow, comprising:

a housing having an inner passage passing therethrough;

a pressure-containing region disposed between the inner passage and the housing; wherein the pressure-containing region comprises at least two stacked sections, and a sensory component at least partially disposed between the inner passage and an outer periphery of the housing.

12. The apparatus of claim 11, wherein the at least two stacked sections includes at least one non-magnetic section.

13. An apparatus for detecting the presence of an anomaly within a longitudinal hollow, comprising:

a housing having an inner passage passing therethrough;

a pressure-containing region disposed between the inner passage and the housing;

a sensory component at least partially disposed between the inner passage and an outer periphery of the housing; and a second sensory component at least partially disposed between the inner passage and an outer periphery of the housing.

14. A method of detecting an anomaly within a longitudinal hollow, comprising:

moving an elongated structure through an inner passage of a detecting apparatus;

sensing the presence of an anomaly of the elongated structure using at least one sensory component, the sensory component at least partially disposed within a housing of the detecting apparatus; and communicating sensory information to an indicator.

15. The method of claim 14 further comprising determining a position of the anomaly within the longitudinal hollow.

16. A method of detecting an anomaly within a longitudinal hollow, comprising;

moving an elongated structure through an inner passage of a detecting apparatus;

sensing the presence of an anomaly of the elongated structure using at least one sensory component, the sensory component at least partially disposed within a housing of the detecting apparatus;

communicating sensory information to an indicator; and determining a direction of movement of the anomaly using a directional sensory component.

17. A method of detecting an anomaly within a longitudinal hollow, comprising:

moving an elongated structure through an inner passage of a detecting apparatus;

sensing the presence of an anomaly of the elongated structure using at least one sensory component, the sensory component at least partially disposed within a housing of the detecting apparatus;

communicating sensory information to an indicator; and, determining a direction of movement of the anomaly using a plurality of sensory components.

18. A method of constructing a tool for detecting the presence of an anomaly within a longitudinal hollow, comprising:

providing a housing having an inner passage passing therethrough;

disposing a pressure-containing region between the inner passage and the housing; and, disposing a sensory component at least partially between the inner passage and an outer periphery of the housing.

19. A method of constructing a tool for detecting the presence of an anomaly within a longitudinal hollow, comprising:

providing a housing having an inner passage passing therethrough;

disposing a pressure-containing region comprising stacked seals between the inner passage and the housing; and, disposing a sensory component at least partially between the inner passage and an outer periphery of the housing.

20. The method of claim 19, wherein the stacked seals comprise alternating magnetic and non-magnetic material.

* * * * *